US005902513A

United States Patent [19]

Shimizu et al.

[11] Patent Number: 5,902,513

[45] **Date of Patent: *May 11, 1999**

[54] MAGNETIC FLUID COMPOSITION

[75] Inventors: Kazuya Shimizu, Fujisawa; Yuusuke Matsumura, Tokyo, both of Japan

[73] Assignee: Taiho Industries Co., Ltd., Tokyo, Japan

[ * ] Notice: This patent is subject to a terminal disclaimer.

[21] Appl. No.: 08/943,224

[22] Filed: Oct. 6, 1997

Related U.S. Application Data

[63] Continuation of application No. 08/622,278, Mar. 27, 1996, abandoned.

[30] Foreign Application Priority Data

Mar. 27, 1995 [JP] Japan ..... 7-092983

[51] Int. Cl.[6] ..... H01F 1/28

[52] U.S. Cl. ..... 252/62.52; 252/62.54; 252/62.53

[58] Field of Search ..... 252/62.52, 62.54, 252/62.53

[56] References Cited

U.S. PATENT DOCUMENTS

| | | | |
|---|---|---|---|
| 4,430,239 | 2/1984 | Wyman | 252/62.52 |
| 4,485,024 | 11/1984 | Furumura et al. | 252/62.51 |
| 4,624,797 | 11/1986 | Wakayama et al. | 252/62.52 |
| 4,626,370 | 12/1986 | Wakayama et al. | 252/62.52 |
| 5,627,147 | 5/1997 | Hayakawa et al. | 252/62.52 |
| 5,629,274 | 5/1997 | Hayakawa et al. | 252/62.52 |

FOREIGN PATENT DOCUMENTS

| | | | |
|---|---|---|---|
| 705050 | 3/1954 | United Kingdom | 252/62.52 |

*Primary Examiner*—Melissa Bonner
*Attorney, Agent, or Firm*—Oblon, Spivak, McClelland, Maier & Neustadt, P.C.

[57] ABSTRACT

A magnetic fluid composition comprising fine magnetic particles in a solvent, wherein said solvent comprises a mixture of a base oil solvent and an ester.

13 Claims, No Drawings

MAGNETIC FLUID COMPOSITION

This application is a continuation of application Ser. No. 08/622,278, filed on Mar. 27, 1996, now abandoned.

BACKGROUND OF THE INVENTION

1. Field of the Invention

The present invention relates to a magnetic fluid composition in which fine magnetic particles are dispersed in a solvent. More specifically, the invention relates to a magnetic fluid composition having excellent stability and which is capable of maintaining excellent fluidity for a long period of time.

2. Discussion of the Background

A magnetic fluid has conventionally been investigated for use in various kinds of devices. A magnetic fluid comprises, for example, a material prepared by coating the surface of fine magnetic particles such as magnetite, Mn—Zn ferrite, Ni—Zn ferrite, or the like, obtained by the coprecipitation method, with a higher fatty acid, or the like as a surfactant by adsorbing and dispersing the coated particles in an oily or aqueous solvent. Examples of such a magnetic fluid and method of preparation are disclosed in Japanese Patent Publications No. 4078/1978 and No. 17118/1978 and Japanese Laid-Open Patent Application No. 105093/1984, or the like.

However, in such a magnetic fluid in which an unsaturated aliphatic acid is used as a surfactant of fine magnetic particles such as magnetite, which coats the particles, and in which the particles are dispersed in an oily solvent, when the fluid is used for a long period of time, a problem which is encountered is that the magnetic fluid gradually deteriorates by oxidation or other polycondensation reactions and gels, which results in lower fluidity.

In recent years, magnetic fluids have become particularly useful in a wide range of fields. For example, they have been used as a shaft sealing solution, a damper solution, a heating medium, or the like and the use of such fluids under high temperature or high humidity conditions is gradually increasing. Under the conditions of high temperatures and high humidity, the reactivity and corrosiveness of magnetic fluids increase which lead to deterioration of the fine magnetic particles because of oxidation, whereby inherent functions are abruptly lost within a short period of time in many cases. In view of these problems, there is a high demand for a magnetic fluid which exhibits less deterioration by preventing oxidation and which can maintain excellent fluidity over a long period of time.

In general, deterioration of an oil has been prevented by adding a small amount of a phenolic, aminic or sulfur containing antioxidant. In this embodiment, it is extremely unusual to add an antioxidant in an amount exceeding 0.5% based on the amount of the oil. With regard to magnetic fluid technology, currently not much is known about what kind of solvent should be used to which an antioxidant is added, how much of what kind of an antioxidant should be used, and other such factors. Incidentally, in Japanese Laid-Open Patent Application No. 105093/1984, there is a description of the necessity of adding a phenolic, aminic, thiophosphate, or the like antioxidant. However, no specific examples of such formulations are described nor any specific method of addition of components. The document further discloses that there is no significant difference between added amounts of antioxidants of 0.1% and 10% in preventing oxidative destruction However, this is the result of ignoring the solubility of an antioxidant in the base oil solvent so that it cannot be said that these conditions give sufficient results depending on the amount of antioxidant added. Also, the effects of addition of antioxidant are not limited to the inhibition of oxidative destruction of the base oil solvent, nor the capability of the antioxidant in preventing polymerization or gelation. A need therefore continues to exist for a magnetic fluid which is very resistant to oxidative deterioration.

SUMMARY OF THE INVENTION

Accordingly, one object of the present invention is to provide a magnetic fluid composition which is extremely resistant to deterioration and which is capable of maintaining its fluidity over a long period of time.

Briefly, this object and other objects of the invention as hereinafter will become more readily apparent can be obtained with a magnetic fluid composition comprising fine magnetic particles in a solvent, wherein the solvent comprises a mixture of a base oil solvent and an ester.

DETAILED DESCRIPTION OF THE PREFERRED EMBODIMENTS

It has now been discovered that there is a material difference in action of an antioxidant added to a magnetic fluid in comparison to the effect of adding an antioxidant to an oil such as a general lubricating oil, because of the structural complexity of a magnetic fluid, particularly its interaction with a surfactant. It has also been found, with respect to the factor of the effective prevention of deterioration of a magnetic fluid by antioxidant action, that an ester type solvent used as a solvent for a magnetic fluid, having a stabilizer such as an antioxidant added thereto in a specific amount, results in the prevention of deterioration of the magnetic fluid by the antioxidant and the viscosity of the magnetic fluid can be controlled without gelation. That is, the magnetic fluid composition of the present invention contains fine magnetic particles in a solvent which comprises a mixture of a base oil solvent and an ester solvent.

It has also been found that upon addition of a phospholipid such as lecithin as another stabilizer, deterioration of the magnetic fluid, because of the agglomeration of fine magnetic particles, can be prevented without affecting the viscosity of the magnetic fluid. Lecithin, as a stabilizer, may be added singly or in combination with the above-antioxidant.

It has been found that by using an ester as the solvent for the magnetic fluid, the solubility of a stabilizer to be added such as an antioxidant is enhanced so that precipitation of the stabilizer can be restrained, which results in materially greater action of the antioxidant. Also, by adding an antioxidant such as an amine antioxidant in a specific amount to a magnetic fluid, it has been found that prevention of deterioration and control of viscosity of the magnetic fluid can be realized. That is, the magnetic fluid composition of the present invention is stable over a long period of time and shows sufficient fluidity even when it is used under severe conditions. In other words, the inherent characteristics of the magnetic fluid can be maintained.

When an antioxidant is employed as a stabilizer, the amount employed widely ranges from 0.5 to 25% by weight, and even larger amounts give a greater effect. However, the viscosity of the magnetic fluid composition to which an antioxidant is added increases depending on the amount of the antioxidant added so that an optimum added amount should be determined in view of the use of the magnetic fluid composition and its durability. For example, when it is used as a damper solution, the viscosity of the magnetic fluid is, in general, desirably higher so that the amount of added stabilizer can be set high. Also, when the magnetic fluid composition of the present invention is to be used as a heating medium, the magnetic fluid is expected to be used under high temperature atmospheres. Heat is a greater factor in hastening gelation of the magnetic fluid so that the amount of antioxidant added is desirably high. The mechanism by which gelation is prevented as a result of the addition of the antioxidant in large amounts is not clear, but the effects are apparent as shown in the Examples infra.

The magnetic fluid descried supra can be an oily magnetic fluid which is itself known in the art and which is obtained by coating fine magnetic particles with an aliphatic acid. The coated particles are dispersed in an oily solvent.

Suitable materials from which the fine magnetic particles are formed for the fluid of the invention include magnetite, Mn—Zn ferrite, Ni—Zn ferrite, and the like. The concentration of the fine magnetic particles in the magnetic fluid is suitably selected within the range of 3 to 70% by weight based on the use of the fluid. Also, as to the aliphatic acid which is coated on the surfaces of the fine magnetic particles, an aliphatic acid having 10 to 30 carbon atoms is usually employed and specific examples of the aliphatic acid are higher aliphatic acids such as oleic acid, stearic acid, linoleic acid, linolenic acid, erucic acid, myristic acid, behenic acid, and the like.

As to the method of applying the aliphatic acid to the fine magnetic particle as a coating, methods conventionally known in the art may be employed. For example, an aliphatic acid salt such as a sodium salt, a potassium salt, an ammonium salt of an aliphatic acid can be contacted with the fine particles. An especially useful method is described in Japanese Patent Publication No. 4078/1978.

Particularly useful aliphatic acid salts include sodium oleate, potassium oleate, ammonium oleate, sodium stearate, sodium erucate, sodium myristate, sodium behenate, and the like.

The amount of the aliphatic acid which absorbs on the fine magnetic particles varies depending on the particle size of the fine magnetic particles to be used, but generally is 5 to 40% by weight based on the amount of the fine magnetic particles.

As described above, the solvent of the present magnetic fluid comprises a mixture of a base oil solvent and an ester solvent. Suitable base oil solvents include aliphatic hydrocarbons, for example, a paraffin such as n-hexane, n-heptane, n-octane, isooctane, kerosene, gas oil, or the like, or a synthetic oil, for example, an isoparaffin petroleum solvent, a hydrogenated poly α-olefin compound or the like, or an aromatic hydrocarbon such as benzene, toluene, xylene, cyclohexane, cyclooctane, an alkylnaphthalene, a phenyl ether, or the like.

On the other hand, the ester solvent of the present invention is present in the solvent of the magnetic fluid in an amount of 1 to 50% by weight, preferably 5 to 45% by weight. Suitable ester solvents include monoesters such as ethyl oleate, butyl oleate and the like; diesters such as dimethyl phthalate, dioctyl phthalate, dioctyl adipate, diisodecyl adipate, didecyl adipate, dioctyl azelate, dioctyl sebacate, dioctyl dimerate, and the like and triesters such as trioctyl trimellitate, triisodecyl trimellitatel and the like. Further, polyol esters may be used which have a structure in which a polyvalent alcohol such as neopentyl glycol (NPG), trimethylolpropane (TMP), pentaerythritol (PE), or the like is reacted with a long chain or branched aliphatic acid having a carbon number of 5 to 18. Preferred examples of such polyesters are the mixed esters of trimethylolpropane which have a basic structure of $CH_3CH_2$—C—$(CH_2OOCR)_3$ in which R represents a $C5-_1$ alkyl group. More specifically, a preferred mixed ester is a trimethylpropane ester of valeric acid and heptanoic acid (produced by Shin-nittetsu Kagaku K. K.; trade name: HATCOL 2915, 2925, 2937, etc.) or a mixed ester oil of trimethylolpropane with decanoic acid or heptanoic acid (produced by Shin-nittetsu Kagaku K. K.; trade name; HATCOL 2938, etc.).

The amount of antioxidant added to the magnetic fluid usually ranges from 0O5 to 25% by weight, preferably 1 to 20% by weight based on the total weight of the magnetic fluid comprising the solvent and the magnetic fine particles. A suitable antioxidant is at least one antioxidant selected from the group consisting of a phenolic antioxidant and an aminic antioxidant which acts as a free radical chain transfer reaction terminating agent or a sulfur containing antioxidant which acts as a peroxide decomposing agent Preferably an aminic antioxidant and a phenolic antioxidant are used in combination Suitable phenolic antioxidants include 2,6-di-t-butylphenol (trade name; Ethyl 701, Irganox L108, etc.), 4,4'-methylenebis(2,6-di-t-butylphenol) (trade name Ethyl 702, Irganox L109, etc.), 2,6-di-t-butyl-4-ethylphenol (trade name; Ethyl 724, etc.) and 2,6-di-t-4-n-butylphenol (trade name; Ethyl 744, etc.).

Incidentally, in view of the factor of compatibility with the base material, 4,4'-methylenebis(2,6-di-t-butylphenol) is preferred.

Suitable amine antioxidants include alkyldiphenylamine (trade name; Irganox L01, L57, L06, etc.) and phenyl-α-naphthylamine (trade name; Irganox L05, etc.). Incidentally, in view of the factor of compatibility with the base material, alkyldiphenylamine is preferred Also, lecithin may be used as a stabilizer in the present magnetic fluid of which phospholipids, widely distributed in living bodies of animals, plants, microorganisms, and the like and having the formula infra a are a type. These phospholipids may be obtained by extracting a phospholipid from a living body and then purifying it.

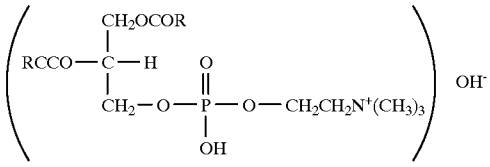

The mechanism by which the lecithin prevents deterioration of the magnetic fluid is not clear, but a possibility is that because of the dispersion promoting action of lecithin, agglomeration of the fine magnetic particles is prevented so that stabilization can be achieved without affecting the viscosity of the magnetic fluid. The amount of lecithin to be added for stabilization of the magnetic fluid is at least 0.1% by weight, preferably at least 1% by weight and more preferably in the range of 0.3 to 3% by weight, of the magnetic fluid composition.

Mixing of the solvent system described above and the stabilizer can be carried out at normal temperature or with heat, and a preferred temperature is 100° C. or lower. By carrying out a mixing treatment with heat within the stated temperature range, mixing by stirring and dissolution becomes easy and the stabilizer can be homogeneously dissolved within the solvent in a short time, which is advantageous. Also, mixing of the solvent and the stabilizer may be carried out before dispersing the fine magnetic particles in the solvent or it may be carried out by adding a specific amount after magnetic fluid is prepared by adding the fine magnetic particles to the solvent.

In general, the viscosity of the magnetic fluid depends on the kind of solvent used and the concentration of the fine magnetic particles and it is difficult to control the viscosity of the fluid, optionally without changing the type of solvent and the concentration of the fine magnetic particles. A method of controlling viscosity of the fluid is known in which a thickener is added to the fluid, but addition of the thickener involves a concern of impairing the dispersion stability or the durability of the magnetic fluid. To the contrary, the magnetic fluid composition of the present invention has an advantage achieved by subjecting the fluid to heat aging which affects the viscosity of the fluid, which viscosity can further be optionally controlled without changing the kind of solvent or the concentration of the fine magnetic particles. Heat aging is carried out by maintaining the fine magnetic particles of the present invention at a predetermined temperature for a predetermined period of time. The viscosity of the controlled magnetic fluid composition depends on the heating time and the temperature. Higher temperatures and longer heating times result in large increments in the viscosity. The heating time is suitably in the range of 1 to 100 hours and the heating temperature is suitably in the range of 80 to 200° C.

The magnetic fluid composition of the present invention can also be used as a pressure seal, a rotary shaft seal, a bearing, selection by difference in specific gravity, a damper, a switch, an acceleration sensor, an inclination sensor, a heat-exchange medium or a heat pipe or a heat sink, or the like.

Having now generally described this invention, a further understanding can be obtained by reference to certain specific examples which are provided herein for purposes of illustration only and are not intended to be limiting unless otherwise specified.

EXAMPLE 1

To a mixed solution of 100 ml of an aqueous ferrous sulfate solution of a concentration of 0.5 mol/l and 100 ml of an aqueous ferric sulfate solution of a concentration of 0.5 mol/l is added 220 ml of an aqueous sodium hydroxide solution of a concentration of 2 mol/l, thereby preparing magnetite. Then, 70 g of an aqueous sodium oleate solution having a concentration of 5% by weight is added to prepare 14.8 of magnetite coated with oleic acid.

Then, 14.8 of the oleic acid coated-magnetite is dispersed in 15 g of a solvent in which alkyldiphenyl ether (trade name: Morescohilube LB-15, produced by K. K. Matsumura Sekiyu Kenkyujo) and diisodecyl adipate (trade name: DIDA, produced by Daihachi Kagaku Kogyo K. K.) were mixed in a ratio of 9:1 to obtain an oily magnetic fluid. To the resulting oily magnetic fluid is added alkyldiphenylamine (trade name. Irganox L57, produced by Shin-nittetsu Kagaku K. K.) in a final formulating amount of 1% by weight and the mixture is dissolved sufficiently at 60° C., thereby preparing a magnetic fluid composition. The ferrite concentration in the magnetic fluid composition is 40% by weight.

EXAMPLE 2

A 14.8 g amount of the oleic acid coated-magnetite obtained in the same manner as descried in Example 1 was dispersed in 15 g of a solvent in which alkyldiphenyl ether (trade name: Morescohilube LB-15, produced by K. K. Matsumura Sekyi Kenkyujo) and diisodecyl adipate (trade name: DIDA, produced by Daihachi Kagaku Kogyo K. K.) is mixed in a ratio of 9:1, thereby obtaining an oily magnetic fluid. To the resulting oily magnetic fluid is added alkyldiphenylamine (trade name: Irganox L57, produced by Shin-nittetsu Kagaku K. K.) in a final formulating amount of 3% by weight. The mixture is dissolved sufficiently at 60° C. thereby preparing a magnetic fluid composition. The ferrite concentration in the magnetic fluid composition is 40% by weight.

EXAMPLE 3

A 14.8 g amount of the oleic acid coated-magnetite obtained in the same manner as described in Example 1 is dispersed in 15 g of a solvent in which alkyldiphenyl ether (trade name: Morescohilube LB-15, produced by K. K. Matsumura Sekiyu Kenkyujo) and diisodecyl adipate (trade name: DIDA, produced by Daihachi Kagaku Kogyo K. K.) are mixed in a ratio of 7:3 thereby preparing an oily magnetic fluid. To the resulting oily magnetic fluid is added alkyldiphenylamine (trade name: Irganox L57, produced by Shin-nittetsu Kagaku K. K.) in a final formulating amount of 6% by weight and the mixture is dissolved sufficiently at 60° C. thereby preparing a magnetic fluid composition. The ferrite concentration in the magnetic fluid composition at this time is 40% by weight.

EXAMPLE 4

A 13.2 g amount of the oleic acid coated-magnetite obtained in the same manner as described in Example 1 is dispersed in 15 g of a solvent in which paraffin oil (trade name: Stanol 52, produced by Esso Sekiyu K. K.) and trioctyl trimellitate (trade name: HATCOL 2920, produced by Shin-nittetsu Kagaku K. K.) are mixed in a ratio of 8:2 thereby obtaining an oily magnetic fluid. To the resulting oily magnetic fluid are added alkyldiphenylamine (trade name: Irganox L57, produced by Shin-nittetsu Kagaku K. K.) and 2,6-di-t-butylphenol (trade name: Irganox L108, produced by Shin-nittetsu Kagaku K. K.) in equal amounts in a final formulating amount of 2% by weight and the mixture is dissolved sufficiently at 60° C. thereby preparing a magnetic fluid composition. The ferrite concentration in the magnetic fluid composition is 40% by weight.

EXAMPLE 5

A 14.8 g amount of oleic acid coated-magnetite obtained in the same manner as described in Example 1 is dispersed 15 g of a solvent in which alkylnaphthalene (trade name: Lion A, produced by Lion K. K.) and tridecyl adipate (trade name: HATCOL 2901, produced by Shin-nittetsu Kagaku K. K.) are mixed in a ratio of 9:1 thereby preparing an oil magnetic fluid. To the resulting oily magnetic fluid is added alkyldiphenylamine (trade name: Irganox L57, produced by Shin-nittetsu Kagaku K. K.) in a final formulating amount of 2% by weight and the mixture is dissolved sufficiently at 60° C. thereby preparing a magnetic fluid composition. The ferrite concentration is the magnetic fluid composition is 40% by weight.

EXAMPLE 6

A 14.8 g amount of the oleic acid coated-magnetite obtained in the same manner as described in Example 1 is dispersed in 15 g of a solvent in which alkyldiphenyl ether (trade name: Morescohilube LB-15, produced by K. K. Matsumura Sekiyu Kenkyujo) and diisodecyl adipate (trade name: DIDA, produced by Daihachi Kagaku Kogyo K. K.) are mixed in a ratio of 9:1 thereby preparing an oily magnetic fluid. To the resulting oily magnetic fluid is added lecithin (produced by Ajinomoto K. K.) in a final formulating amount of 1% by weight and the mixture is dissolved sufficiently at 60° C. thereby preparing a magnetic fluid composition. The ferrite concentration in the magnetic fluid composition is 40% by weight.

EXAMPLE 7

A 14.8 g amount of the oleic acid coated-magnetite obtained in the same manner as described in Example 1 is dispersed in 15 g of a solvent in which alkyldiphenyl ether (trade name: Morescohilube LB-15, produced by K. K. Matsumura Sekiyu Kenkyujo) and diisodecyl adipate (trade name: DIDA, produced by Daihachi Kagaku Kogyo K. K.) are mixed in a ratio of 9:1 thereby preparing an oily magnetic fluid. To the resulting oily magnetic fluid is added alkyldiphenylamine (trade name: Irganox L57, produced by Shin-nittetsu Kagaku K. K.) in a final formulating amount of 1% by weight and lecithin (produced by Ajinomoto K. K.) in a final formulating amount of 1% by weight. The mixture is dissolved sufficiently at 60° C. thereby preparing a magnetic fluid composition. The ferrite concentration in the magnetic fluid composition is 40% by weight.

Comparative Example 1

A 14.8 g amount of the oleic acid-magnetite obtained in the same manner as described in Example 1 is dispersed in 15 g of a solvent in which alkyldiphenyl ether (trade name: Morescohilube LB-15, produced by K. K. Matsumura Sekiyu Kenkyujo) and diisodecyl adipate (trade name: DIDA, produced by Daihachi Kagaku Kogyo K. K.) is mixed in a ratio of 9:1 thereby preparing an oily magnetic fluid. To the resulting oily magnetic fluid is added alkyldiphenylamine (trade name: Irganox L57, produced by Shin-nittetsu Kagaku K. K.) in a final formulating amount of 0.3% by weight and the mixture is dissolved sufficiently at 60° C. thereby obtaining a magnetic fluid composition. The ferrite concentration in the magnetic fluid composition is 40% by weight.

Comparative Example 2

A 13.2 g amount of the oleic acid coated-magnetite obtained in the same manner as described in Example 1 is dispersed in 15 g of a solvent in which paraffin oil (trade name: Stanol 52, produced by Esso Sekiyu, K. K.) and trioctyl trimellitate (trade name: HATCOL 2920, produced by Shin-nittetsu Kagaku K. K.) are mixed in a ratio of 8:2 thereby preparing an oily magnetic fluid. To the resulting oily magnetic fluid is added alkyldiphenylamine (trade name: Irganox L57, produced by Shin-nittetsu Kagaku K. K.) and 2,6-di-t-butylphenol (trade name: Irganox L108, produced by Shin-nittetsu Kagaku K. K.) in equal amounts in a final formulating amount of 0.2% by weight. The mixture is dissolved sufficiently at 60° C. thereby preparing a magnetic fluid composition. The ferrite concentration in the magnetic fluid composition is 40% by weight.

Comparative Example 3

A 14.8 g amount of the oleic acid coated-magnetite obtained in the same manner as described in Example 1 is dispersed in 15 g of alkylnaphthalene (trade name: Lion A, produced by Lion K. K.) thereby obtaining an oily magnetic fluid. The ferrite concentration in the magnetic fluid composition is 40% by weight.

With regard to the thus obtained magnetic fluid compositions, heat-resistant stability and humidity-resistant stability were evaluated by carrying out the accelerating tests shown below in Table 1

TABLE 1

| | Heat resistance | Humidity resistance |
|---|---|---|
| Example 1 | ○ | ○ |
| Example 2 | ◎ | ○ |
| Example 3 | ◎ | ◎ |
| Example 4 | ○ | ○ |
| Example 5 | ◎ | ○ |
| Example 6 | ○ | Δ |
| Example 7 | ◎ | ○ |
| Comparative example 1 | Δ | X |
| Comparative example 2 | X | X |
| Comparative example 3 | X | X |

Evaluation of Heat Resistance

The magnetic fluid composition embodiments were each placed in a petri dish and the petri dishes were placed in an airborne type thermostat set at a temperature at 140° C., and the progress of gelation was observed while maintaining the temperature. More specifically, fluidity states of the magnetic fluid compositions after 150 hours, 200 hours, 250 hours and 300 hours were evaluated.

The evaluation standards are (i) X, which indicates the composition gelled at the lapse of 150 hours, (ii) Δ, which indicates that fluidity was lost at the lapse of 200 hours, (iii) ○, which indicates that the fluidity was lost at the lapse of 250 hours, and (iv) ◎, which indicates that the fluidity was retained even after the lapse of 300 hours.

Evaluation of Humidity Resistance

The resulting magnetic fluid compositions were each placed in a petri dish and the petri dishes were placed in a thermostat set a temperature of 80° C. and a humidity of 85%. The conditions are maintained. Evaluations were carried out by examining the states of the magnetic fluid compositions after 150 hours, 200 hours, 250 hours and 300 hours.

The evaluation standards are (i) X, which indicates that the composition gelled the lapse of 150 hours, (ii) Δ, which indicates that fluidity was lost at the lapse of 200 hours, (iii) ○, which indicates that fluidity was lost at the lapse of 250 hours, and (iv) ◎, which indicates that fluidity was retained even after the lapse of 300 hours.

It can be mentioned that the fine magnetic particles of the Examples can also be prepared from Mn—Zn ferrite, or Ni—Zn ferrite. Also, higher fatty acids can be employed as the surfactant in the Examples.

As described above, in the present invention, by adding an ester solvent as a solvent component of the magnetic fluid, the dissolution of a stabilizer such as an antioxidant, to be added thereto is accelerated which prevents precipitation. The action of the stabilizer such as an antioxidant is markedly increased. Further, by adding an antioxidant to a solvent of the magnetic fluid in a specific amount, prevention of deterioration and control of the viscosity of the magnetic fluid can be realized. Thus, deterioration of the magnetic fluid can be markedly decreased and fluidity can be maintained over a long period of time, and particularly the reliability of the magnetic fluid composition at high temperature and high humidity can be enhanced.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A magnetic fluid composition, comprising:

fine magnetic particles in a solvent comprising a mixture of a base oil and an ester solvent selected from the group consisting of monoesters, a triester selected from the group consisting of trioctyl trimellitate and triisodecyl trimellitate, and a polyol ester of neopentyl glycol, trimethylolpropane or pentaerythritol reacted with a long chain or branched chain $C_{5-18}$ aliphatic acid.

2. The magnetic fluid of claim 1, wherein the ester component in the solvent of the fluid is present in an amount of 1 to 50% by wt.

3. The magnetic fluid of claim 1, wherein the base oil solvent is an aliphatic hydrocarbon, a synthetic oil, a hydrogenated poly α-olefin or an aromatic hydrocarbon.

4. A magnetic fluid composition, comprising:

fine magnetic particles and a stabilizer in a solvent comprising a mixture of a base oil and an ester solvent selected from the group consisting of monoesters, a triester selected from the group consisting of trioctyl trimellitate and triisodecyl trimellitate, and a polyol ester of neopentyl glycol, trimethylolpropane or pentaerythritol reacted with a long chain or branched chain $C_{5-18}$ aliphatic acid.

5. The magnetic fluid composition according to claim 4, wherein said stabilizer is an antioxidant.

6. The magnetic fluid composition according to claim 5, wherein said antioxidant is present in an amount of at least 0.5% by weight based on the weight of the magnetic fluid composition.

7. The magnetic fluid composition of claim 6, wherein said antioxidant is present in an amount of 25% by weight or less based on the weight of the magnetic fluid composition.

8. The magnetic fluid of claim 4, wherein the ester component in the solvent of the fluid is present in an amount of 1 to 50% by wt.

9. The magnetic fluid of claim 4, wherein the base oil solvent is an aliphatic hydrocarbon, a synthetic oil, a hydrogenated poly α-olefin or an aromatic hydrocarbon.

10. The magnetic fluid of claim 4, wherein said stabilizer is a phenolic antioxidant, an aminic antioxidant or a sulfur containing antioxidant.

11. The magnetic fluid of claim 4, wherein lecithin is said stabilizer and is present in an amount of at least 1% by weight.

12. A magnetic fluid composition, comprising:

fine magnetic particles and a lecithin stabilizer in an amount of at least 1% by weight in the composition in a solvent mixture of a base oil and a triester or polyol ester.

13. The magnetic fluid composition of claim 12, wherein said triester is trioctyl trimellitate or triisodecyl trimellitate and said polyol ester is an ester of a polyvalent alcohol and a long chain or branched aliphatic acid having a carbon atom content of 5–18.

* * * * *